United States Patent [19]

Tiitola

[11] 4,059,269

[45] Nov. 22, 1977

[54] HOCKEY STICK OR THE LIKE, PARTICULARLY BLADE STRUCTURE THEREOF

[75] Inventor: Antti-Jussi Tiitola, Tampere, Finland

[73] Assignee: Karhu-Titan Oy, Finland

[21] Appl. No.: 658,098

[22] Filed: Feb. 13, 1976

Related U.S. Application Data

[63] Continuation-in-part of Ser. No. 527,448, Nov. 26, 1974, Pat. No. 3,982,760.

[30] Foreign Application Priority Data

Feb. 18, 1975 Finland ..... 750454

[51] Int. Cl.[2] ..... A63B 59/12

[52] U.S. Cl. ..... 273/67 A

[58] Field of Search ..... 273/67 R, 67 A, 67 D, 273/73 F, 80 Z, 167 R, 167 A, DIG. 1–DIG. 12, 82 R, 82 B, 174; 280/608, 610

[56] References Cited

U.S. PATENT DOCUMENTS

| | | | |
|---|---|---|---|
| 1,017,565 | 2/1912 | Lard | 273/81.6 |
| 2,304,322 | 12/1942 | Werlich | 273/67 A |
| 2,428,325 | 9/1947 | Collins | 273/73 F X |
| 2,851,277 | 9/1958 | Holmberg et al. | 280/11.13 L |
| 3,444,568 | 5/1969 | Vogelsang | 273/67 R X |
| 3,529,825 | 9/1970 | White | 273/67 A |
| 3,533,623 | 10/1970 | Dumont | 273/67 A |
| 3,561,760 | 2/1971 | Klay | 273/67 A |

FOREIGN PATENT DOCUMENTS

| | | | |
|---|---|---|---|
| 591,454 | 1/1960 | Canada | 273/67 A |
| 42,515 | 4/1970 | Finland | 273/67 A |
| 21,920 | 8/1947 | Finland | 273/67 A |
| 2,005,952 | 10/1971 | Germany | 273/67 A |
| 2,353,843 | 10/1974 | Germany | 273/67 A |
| 56,706 | 6/1936 | Norway | 273/67 D |
| 90,729 | 1/1958 | Norway | 273/67 A |
| 744,778 | 2/1956 | United Kingdom | 273/67 D |
| 846,673 | 8/1960 | United Kingdom | 273/67 A |
| 932,221 | 7/1963 | United Kingdom | 273/67 D |
| 272,851 | 3/1970 | U.S.S.R. | 273/67 A |

*Primary Examiner*—Richard J. Apley
*Attorney, Agent, or Firm*—Steinberg & Blake

[57] ABSTRACT

A stick to be used in ice hockey or the like, and in particular the blade structure thereof. The blade structure has a core consisting in its entirety of a single elongated body of wear-resistant material extending all the way from the bottom to the top edge regions as well as from the front tip to the rear end regions of the blade structure. This single core body has opposed side surfaces covered almost but not entirely by a pair of strengthening layers, preferably of reinforced plastic, while the core body itself is preferably made of wear-resistant plastic material. The core body projects downwardly beyond the strengthening layers as well as upwardly beyond the same to provide the blade structure with wear and impact-resistant elongated lower and upper edge regions formed by the core body itself. Preferably the core body also extends forwardly beyond the strengthening layers so as to be exposed and provide the blade with a wear and impact-resistant front tip region formed by the core body itself. The strengthening layers are themselves covered by a pair of protective layers made, for example, of wood veneer.

12 Claims, 3 Drawing Figures

HOCKEY STICK OR THE LIKE, PARTICULARLY BLADE STRUCTURE THEREOF

CROSS REFERENCE TO RELATED APPLICATION

This application is a continuation-in-part of copending application Ser. No. 527,448, filed Nov. 26, 1974, now U.S. Pat. No. 3,982,760.

BACKGROUND OF THE INVENTION

The present invention relates to sticks of the type used in ice hockey or similar games.

The blade structure of such sticks generally includes an interior core which has opposed side surfaces joined with a pair of reinforced plastic layers the length of which are substantially equal to the length of the entire blade, these reinforced plastic layers being laminated onto the core and being themselves covered by protective layers of wood veneer or equivalent material.

The blade structure of the present invention may be used with an elongated handle structure such as that disclosed in the above parent application or other handle structures.

With respect to the state of the art, reference may be made to Finnish Pat. No. 42,515 which discloses a stick substantially characterized by the fact that it has a core made up of core pieces which serve to provide for the stick the required thickness while reinforced plastic laminations are disposed symmetrically on both sides of the core pieces and have a length equal to that of the entire stick, with wood veneer layers covering the reinforced plastic laminations so as to protect the latter.

Experience gained in practice has revealed that sticks of the above type while possessing excellent strength characteristics nevertheless are faulty with respect to the fact that at the lower edge region of the blade structure of the stick there is a particular problem resulting from the wear of the stick at the lower edge of the blade structure thereof. In addition, a problem has been encountered with respect to the fact that the upper edge of the blade of the stick is susceptible to damage. An indirect consequence of the wear of the lower edge of the reinforced plastic laminations, required to give the stick structure a desired strength, is that these laminations tend to be torn away from the core at the lower edge of the blade, resulting in destruction of the blade of the stick.

SUMMARY OF THE INVENTION

It is accordingly a primary object of the present invention to provide a stick for ice hockey or the like which will avoid the above drawbacks.

In particular, it is an object of the present invention to provide a stick of the above type which is of an exceedingly simple construction so that the manufacture of the stick may be carried out in a simpler manner than has heretofore been possible.

A further object of the present invention is to provide a blade with a core structure which does not require an assembly of a plurality of parts.

A more general object of the present invention is to provide a stick for ice hockey or the like which is characterized not only by simplicity in its construction and in the manufacture thereof but also by an exceedingly long operating life as well as excellent operating characteristics.

According to the invention the blade has a core which consists in its entirety of a single core body made of a wear-resistant material such as a plastic, preferably a thermoplastic material such as acrylonitrile butadiene styrene, with this single core body having exposed elongated upper and lower edges resistant to wear and impact while preferably also having an exposed front edge region at the tip of the blade.

BRIEF DESCRIPTION OF DRAWINGS

The invention is illustrated by way of example in the accompanying drawings which form part of this application and in which.

DESCRIPTION OF PREFERRED EMBODIMENTS

According to the present invention, the blade structure of the stick which is suitable for ice hockey or the like has a core which consists in its entirety of a single body 10 which serves to give the blade of the stick its required dimensions but which otherwise has no substantial effect on the strength of the blade.

Figure 1:
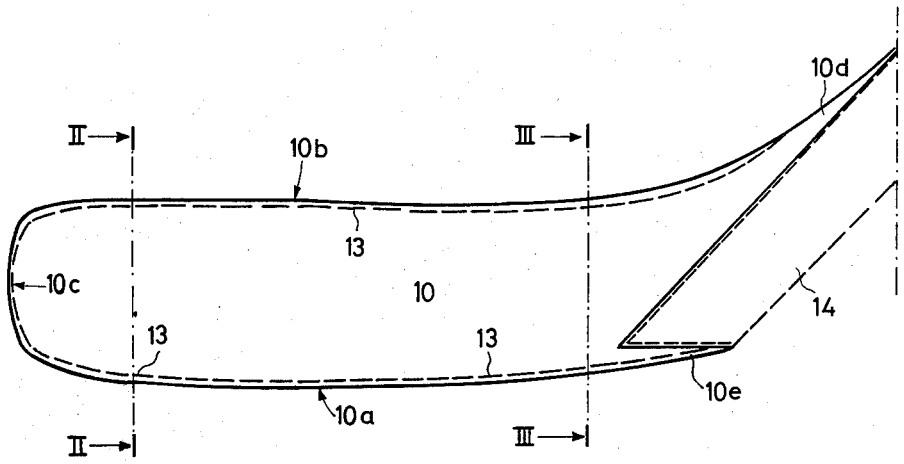
FIG. 1 is a side elevation of a core body of a blade structure of the invention, with FIG. 1 showing in dotted lines the area of the core body covered by strengthening and protective layers as well as also showing in dotted lines part of a handle core where it is attached to the blade core.

At the rear end region of the core body 10, shown at the right of FIG. 1, there is schematically and fragmentarily illustrated in FIG. 1 a core portion 14 of the handle of the stick, the design and structure of the elongated handle which extends upwardly and is inclined rearwardly from the blade being of no particular importance with respect to the present invention.

For the purpose of joining the elongated handle shaft and the blade structure to each other, the core body 10 has at its rear end region a recess or indentation defined by the upper projecting portion **10*d* of the body 10 and the lower projecting portion 10*e* thereof. It will be noted that the projecting portion 10*d* tapers upwardly substantially to a point and forms an extension of the elongated upper edge region 10*b* of the body 10 while the lower projecting portion 10*e* also tapers substantially to a point which is situated at the rear end of the elongated lower edge region 10*a* of the body 10. The core 14 which is shown in phantom lines is joined in any suitable way to the projecting portions 10*d* and 10*e***.

The single core body 10 is made of a material which is highly resistant to wear as well as impact, and preferably is made of a thermoplastic material such as acrylonitrile butadiene styrene (ABS resin) or other equivalent plastic materials such as polystyrenes or other polyacrylonitriles and copolymers thereof.

Figure 2:
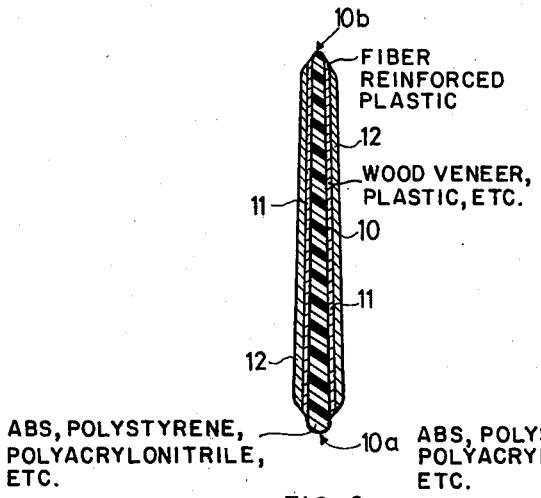
FIG. 2 is a transverse sectional elevation of the core body of FIG. 1 taken along line II—II of FIG. 1 in the direction of the arrows and showing in addition in section the strengthening and protective layers joined to the opposed side surfaces of the core body.
Figure 3:
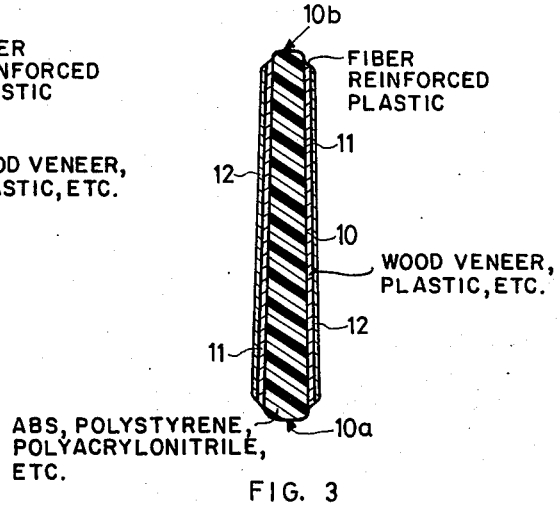
FIG. 3 is a transverse sectional elevation taken along line III—III of FIG. 1 in the direction of the arrows showing in addition to the core body the strengthening and protective layers joined thereto.

As is apparent particularly from FIGS. 2 and 3, the core body 10 tapers upwardly from its bottom edge region **10*a* to its upper edge region 10*b* so that the core body is thicker at its bottom edge region 10*a* than its upper edge region 10*b***. Also, as is apparent from FIGS.

2 and 3, the core body 10 tapers forwardly from its rear end region toward its front tip region 10*c*, so that the core body is thicker at its rear end region than at its front tip region.

In a manner which is known in the art, as, for example, from the teaching of Finnish Pat. No. 42,515, strengthening layers 11 are joined to the opposed side surfaces of the core body 10, these layers 11 being, for example, reinforced plastic layers pressed onto the core body 10 at its opposed side surfaces and extending substantially but not entirely over the length and breadth of the blade as well as possibly over the exterior surfaces of the core 14 of the handle shaft. The reinforced plastic strengthening layers 11 may be composed, for example, the following materials: polyester resin or epoxy resin with the following reinforcement fibers: glass fibers, carbon fibers, borax fibers, or organic polyamid fiber.

These strengthening layers 11 are in turn covered at their outer surfaces, which are directed away from the core body 10, by protective layers 12. These protective layers 12 may be joined with the strengthening layers 11 in the same prssing operation during which the strengthening layers 11 are joined with the core body 10. The protective layers 12 may take the form of wood veneers, although these wood veneers may be replaced, for example, by equivalent plastic layers or by fabric coverings. The outer margin of the wood veneer 12 and of course of the reinforced plastic layer 11 covered thereby at each side of the core body 10 is indicated by the dotted line 13 in FIG. 1.

During the manufacturing step when the blade is machined, care is taken to make certain that the reinforced plastic layers 11 which impart the strength to the blade do not extend all the way down to the lower edge region 10*a* of the core body 10 so that the core body 10 itself forms the bottom sliding edge region of the blade, and in this way the wear and impact resistant material of the core body 10 serves in all and any conditions as a wear-resistant sliding surface between the bottom of the blade and the ice. In this way, since the core body 10 extends downwardly beyond the layers 11 and 12, detachment of the lower edge regions of the latter from the remainder of the structure is prevented.

In the same way, the upper edge region 10*b* of the core body 10 extends upwardly beyond the strengthening layers 11 and the protective layers 12 covering the same, so that in this way there is exposed along the upper edge region of the blade the edge region 10*b* of the core body which thus provides the stick with a blade having an upper edge region which is highly resistant to wear and impact.

As is apparent from FIG. 1, the same considerations apply to the front tip region 10*c* of the core body 10. The strengthening layers 11 and protective layers 12 extend almost up to the front tip region 10*c* of the core body 10. Thus in this way the core body 10 also projects forwardly beyond the layers 11 and 12 to have an exposed front tip region 10*c* which is highly resistant to wear and impact.

Thus, the structure of the present invention provides for the stick, particularly at the blade thereof, different components which operate so as to carry out predetermined tasks. The core body 10 which is made of a sufficiently durable while at the same time light material is also easy to machine and to shape and maintains the structural reinforced plastic layers 11 properly spaced from each other so as to achieve in this way a sufficient strength and rigidity for the stick. The plastic or wood protective layers 12 serve to prevent scratching and wearing of the reinforced plastic layers 11. The bottom rail formed by the lower exposed edge region 10*a* of the core body 10 absorbs impacts between the stick and the ice and protects the bottom edge region of the blade structure against wear. The front tip region 10*c* and the elongated upper edge region 10*b* of the core body constitute impact-resistant edging for the blade. It will be seen that an important feature of the invention resides in the fact that the elongated lower and upper edge regions 10*a* and 10*b* of the thermoplastic material extend over the entire length of the blade.

The tapered rear upper and lower projecting portions 10*d* and 10*e* of the core body 10 give the possibility of providing an extremely strong and secure connection with the elongated handle shaft of the stick. Moreover, the tapering of the core body from its bottom to its upper edge region provides the blade with a bottom edge region 10*a* of substantial area increasing in this way the wear-resistance while at the same time maintaining the lightness in the weight and affording highly favorable handling of the stick due to the large bottom surface area provided by the thicker bottom edge region and due to the lowering of the center of gravity of the blade through this construction. The same considerations apply with respect to the tapering of the body from the rear end region to the front tip region thereof inasmuch as in this way also the center of gravity is displaced toward the rear end region of the blade affording an easy and effective maneuverability of the front tip region so as to render the blade of the invention also easy to manipulate in a highly effective manner as a result of this feature.

What is claimed is:

1. In a stick to be used in ice hockey or the like, a lower blade structure having a core consisting in its entirety of a single body of wear-resistant material extending all the way from a front tip of the blade structure to a rear end thereof as well as all the way from a lower edge of the blade structure to a top edge thereof, said body having opposed side surfaces, a pair of opposed strengthening layer respectively joined to and almost but not entirely covering said opposed side surfaces of said core body, the latter having an elongated bottom edge region extending along the entire length of the blade structure and extending downwardly beyond said strengthening layers and said core body also having an upper elongated edge region extending along the entire length of the blade structure upwardly beyond said strengthening layers, whereby said wear-resistant core body is exposed at its elongated bottom and upper edge regions for providing the blade structure with wear and impact resistant regions at least along the lower and upper edges of the blade structure.

2. The combination of claim 1 and wherein said core body also extends forwardly beyond said strengthening layers at the front tip region of the blade structure all the way from the bottom edge region to the upper edge region of the core body so as to provide the blade structure also with a front tip edge region which is resistant to wear and impact.

3. The combination of claim 1 and wherein said core body is made of a wear-resistant plastic material.

4. The combination of claim 3 and wherein said plastic material is a thermoplastic material.

5. The combination of claim 4 and wherein said thermoplastic material is acrylonitrile butadiene styrene.

6. The combination of claim 3 and wherein said strengthening layers are made of a reinforced plastic sheet material.

7. The combination of claim 6 and wherein said strengthening layers respectively have outer side surfaces directed away from said core body, and a pair of protective layers respectively covering said outer surfaces of said strengthening layers.

8. The combination of claim 7 and wherein said protective layers are made of a wood veneer.

9. The combination of claim 3 and wherein said core body has at its rear end region upper and lower projecting portions which define a recess between themselves, and at least a core portion of a handle of the stick being received in said recess and joined to said projecting portions of said core body.

10. The combination of claim 9 and wherein said lower projecting portion at said rear end region of said core body tapers substantially to a point at a rear end of the lower edge region of the core body while said upper projecting portion at the rear end region of said core body tapers upwardly substantially to a point and defines an upwardly and rearwardly curved extension of the upper edge region of the core body.

11. The combination of claim 3 and wherein said core body has between its front and rear end regions a thickness which tapers upwardly from the bottom edge region to the upper edge region of the core body so that the latter is thicker at its bottom edge region than at its upper edge region.

12. The combination of claim 11 and wherein said core body also tapers from its rear end region toward its front tip region so that the core body is thicker at its rear end region than at its front tip region.

* * * * *